US009021799B1

(12) United States Patent
Taylor et al.

(10) Patent No.: US 9,021,799 B1
(45) Date of Patent: May 5, 2015

(54) HYDRAULIC MOTOR ASSEMBLY

(75) Inventors: Michael W. Taylor, Sullivan, IL (US); Heath F. McCormick, Shumway, IL (US); Thomas J. Langenfeld, Sullivan, IL (US); Nathan W. Bonny, Shelbyville, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 961 days.

(21) Appl. No.: 13/115,343

(22) Filed: May 25, 2011

Related U.S. Application Data

(60) Provisional application No. 61/426,225, filed on Dec. 22, 2010, provisional application No. 61/348,607, filed on May 26, 2010.

(51) Int. Cl.
*F03C 1/06* (2006.01)
*F15B 9/08* (2006.01)

(52) U.S. Cl.
CPC ..... *F15B 9/08* (2013.01)

(58) Field of Classification Search
CPC .... F03C 1/0663; F03C 1/0665; F03C 1/0431; F16H 61/47; F16H 39/02; F16H 39/10
USPC ..... 60/487, 488, 455; 91/503, 485; 92/86
See application file for complete search history.

(56) References Cited

U.S. PATENT DOCUMENTS 2,470,220 A * 5/1949 Mott ..... 417/272
3,575,521 A * 4/1971 Porter et al. ..... 415/27
4,122,974 A 10/1978 Harbert et al.
4,314,515 A 2/1982 Jimenez et al.
5,927,073 A * 7/1999 Ishizaki et al. ..... 60/487
6,343,471 B1 * 2/2002 Thoma et al. ..... 60/487
6,880,686 B1 4/2005 Hauser et al.
6,884,195 B2 * 4/2005 Thoma et al. ..... 475/83
6,886,315 B1 5/2005 Hauser et al.
6,951,093 B1 10/2005 Hauser et al.
7,017,326 B1 3/2006 Keller et al.
7,032,377 B1 4/2006 Keller et al.
7,185,596 B2 3/2007 Thiemke et al.
7,242,180 B1 * 7/2007 O'Connor ..... 324/207.2
7,266,938 B1 9/2007 Hauser et al.
7,313,914 B1 1/2008 Reid et al.
7,473,207 B1 1/2009 Hauser et al.
7,503,174 B1 3/2009 Reid et al.
7,735,438 B2 6/2010 Riewerts
7,908,850 B1 3/2011 Reid et al.

* cited by examiner

*Primary Examiner* — Nathaniel Wiehe
*Assistant Examiner* — Abiy Teka
(74) *Attorney, Agent, or Firm* — Neal, Gerber & Eisenberg LLP

(57) ABSTRACT

A hydraulic motor assembly capable of precise control having a housing, a hydraulic mounting surface located in the housing, a cylinder block rotatably disposed on the hydraulic mounting surface, a motor shaft engaged to the cylinder block and supported proximate to a first end, a plurality of cooperating gears located in the housing and rotationally engaged to a second end of the motor shaft, an output shaft rotationally engaged to the plurality of cooperating gears, a speed sensor located proximate to one of the plurality of cooperating gears, wherein the speed sensor transmits a signal indicative of the rotational speed of the one of the plurality of cooperating gears.

24 Claims, 8 Drawing Sheets

HYDRAULIC MOTOR ASSEMBLY

CROSS REFERENCE

This application claims the benefit of U.S. Provisional Patent Application Ser. No. 61/348,607 filed on May 26, 2010 and U.S. Provisional Patent Application Ser. No. 61/426,225 filed on Dec. 22, 2010. The contents of both applications are incorporated herein by reference.

BACKGROUND OF THE INVENTION

This application relates to motor assemblies generally and, in particular, to hydraulic motor assemblies intended for use in driving a vehicle or other apparatus, such as a seed planting mechanism, a powered implement or a walk-behind machine such as a mower or snow thrower, for example.

SUMMARY OF THE INVENTION

An improved hydraulic motor assembly is disclosed herein. One or more hydraulic motor assemblies can be mounted on a vehicle or other powered equipment to drive, for example, one or more wheels, implements or shafts. A speed sensor can be incorporated in the hydraulic motor assembly to provide operational feedback to an electronic controller that precisely regulates the motor assembly's output via direct control of a hydraulic pump in fluid communication with the hydraulic motor assembly.

A hydraulic motor assembly generally requires a case drain to remove the volume of fluid losses from the hydraulic motor that accumulate in the motor chamber. To eliminate the need for additional structure, such as additional hydraulic line and case drain port, an internal case drain may be provided. This can be a particular advantage when the hydraulic motor assembly is distant from its corresponding pump as in the case of an agricultural seed planter.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

Figure 1:
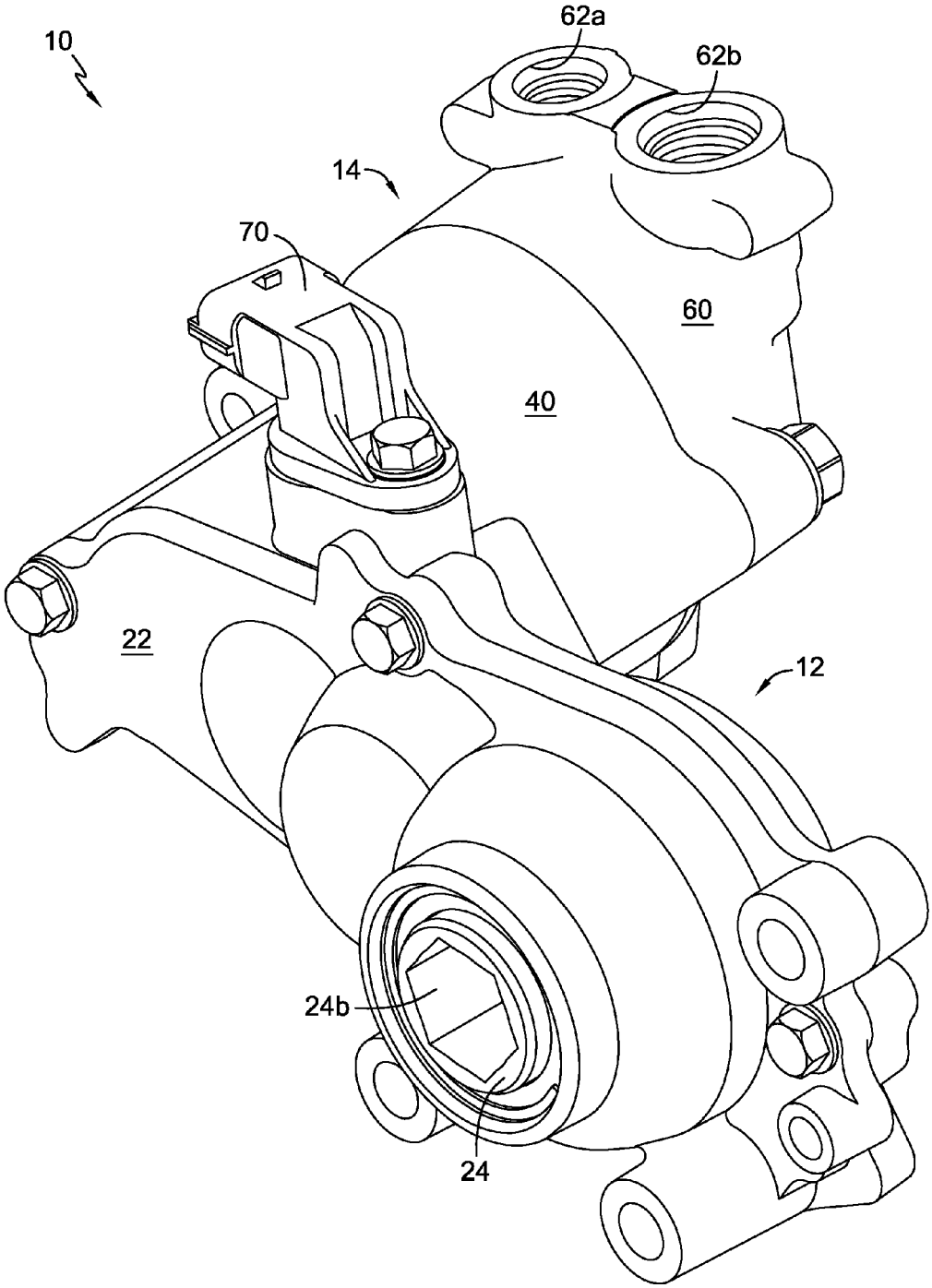
FIG. 1 is a perspective view of a first embodiment of a hydraulic motor assembly with speed sensor in accordance with the principles of the invention.

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. As stated above, the present specification is intended to be taken as a whole and interpreted in accordance with the principles of the present invention as taught herein and understood by one of ordinary skill in the art.

Figure 2:
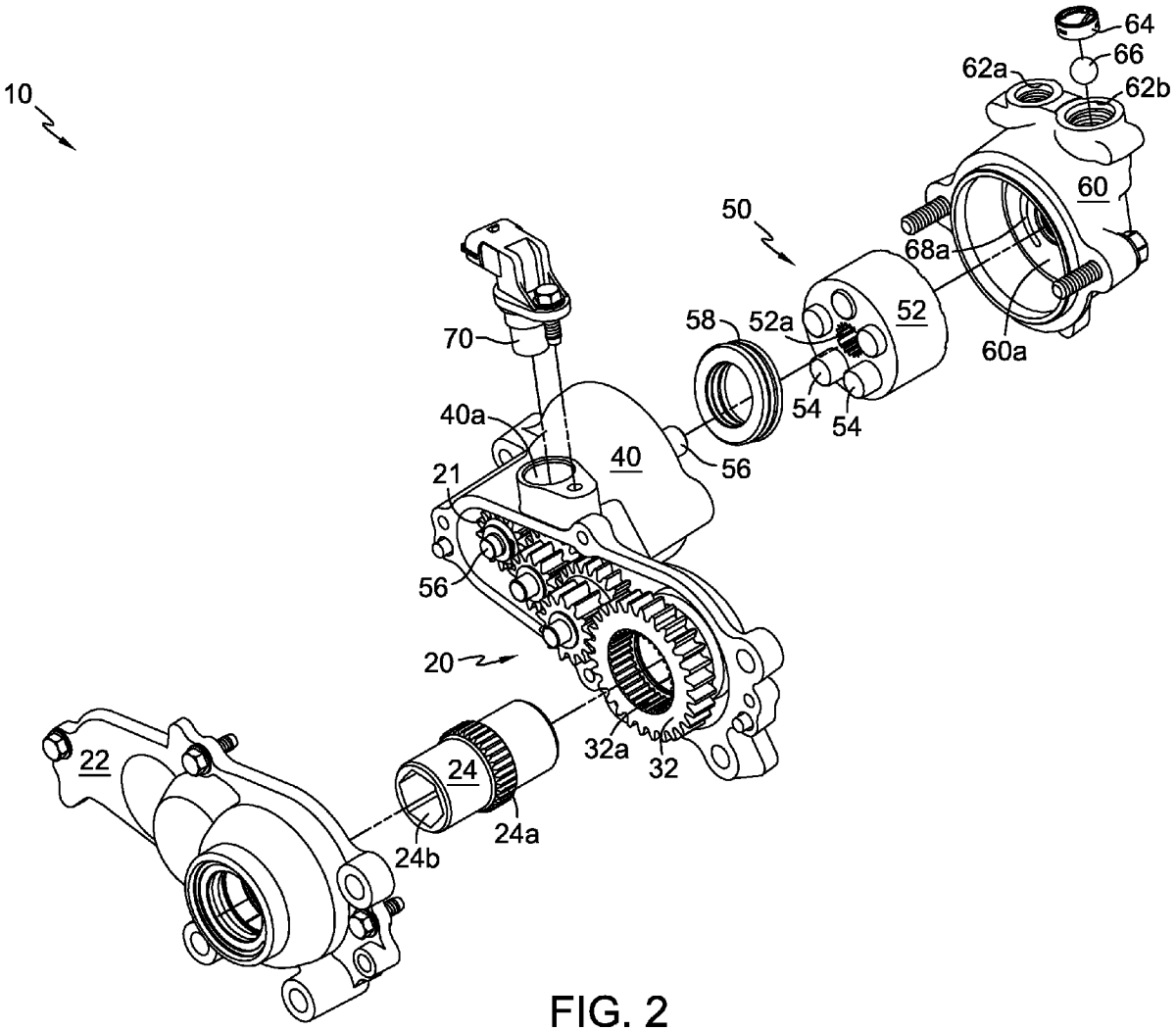
FIG. 2 is a partially exploded perspective view of the hydraulic motor assembly with speed sensor of FIG. 1.
Figure 3:
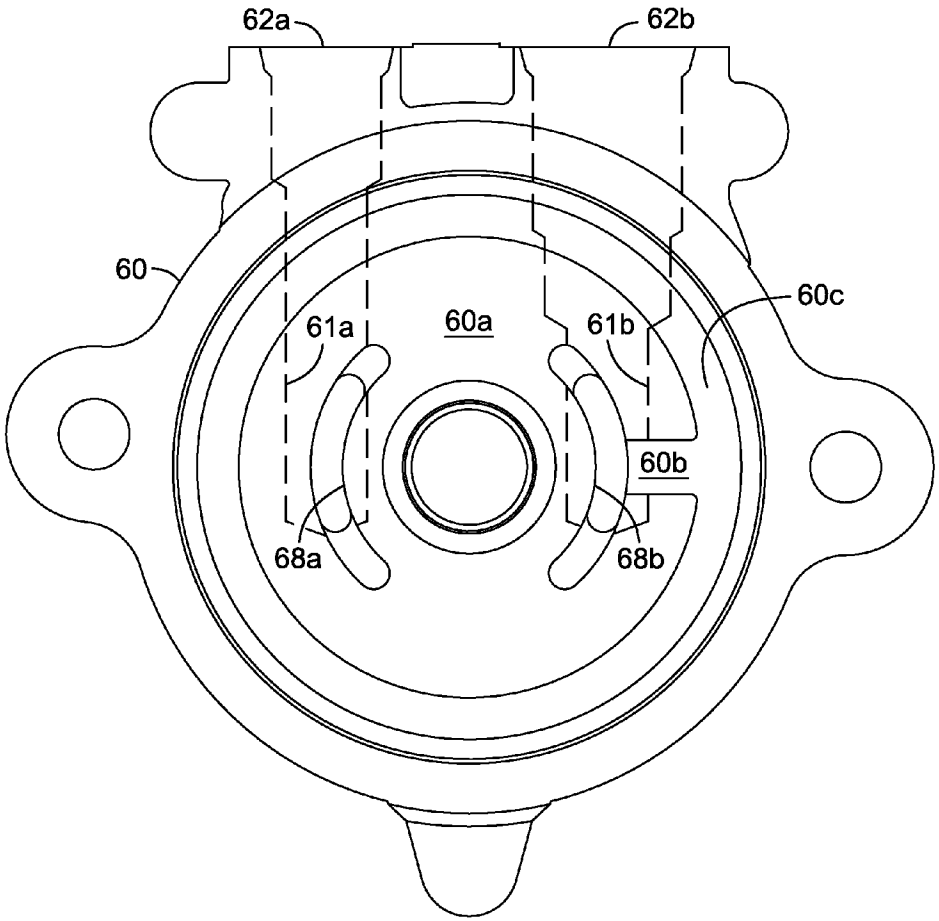
FIG. 3 is an elevational view of a motor housing of the hydraulic motor assembly with speed sensor of FIG. 1.
Figure 4:
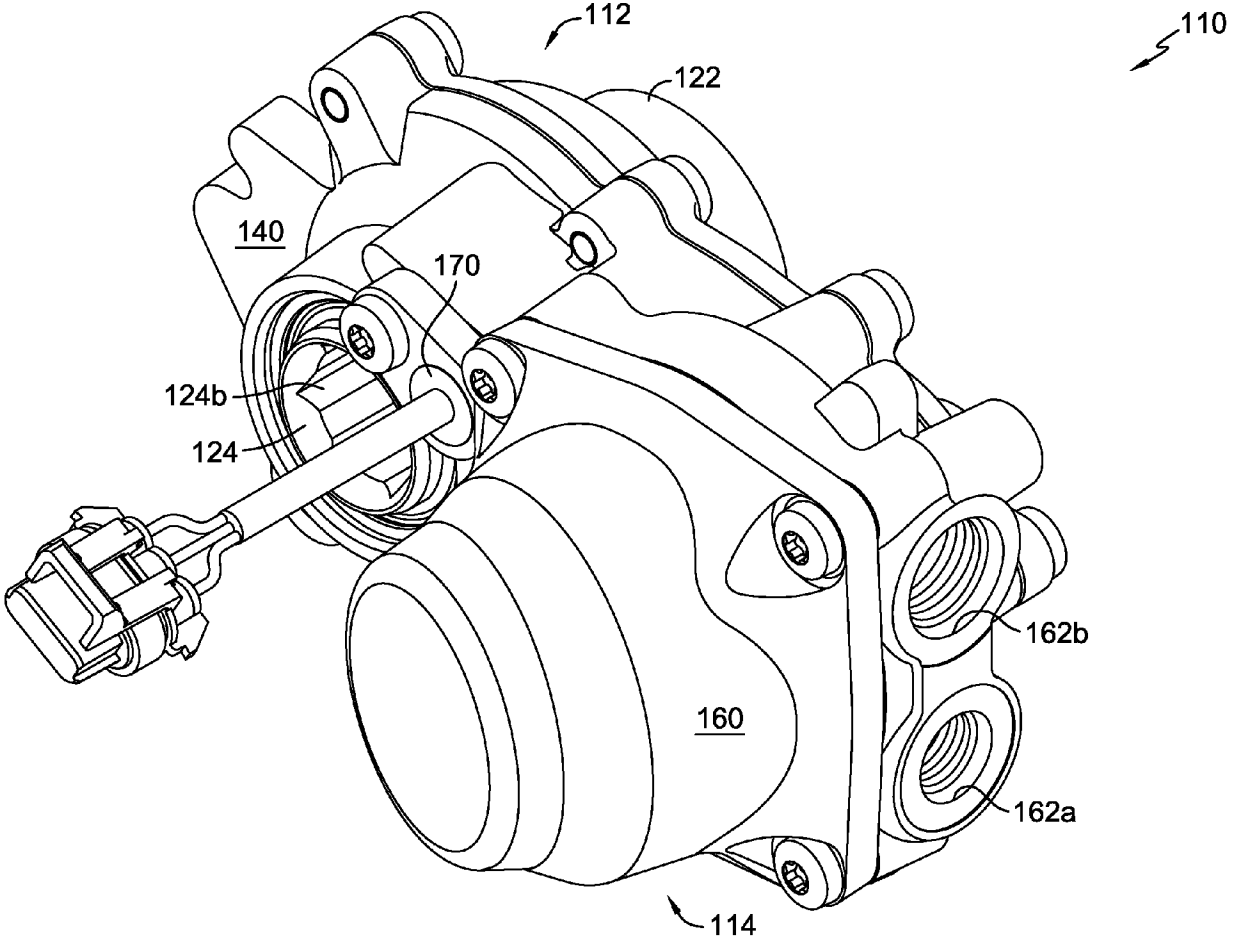
FIG. 4 is a perspective view of a second embodiment of a hydraulic motor assembly with speed sensor in accordance with the principles of the invention.

Referring to FIGS. 1-3, a first embodiment of a hydraulic motor assembly 10 of the present invention includes a gear assembly 20 housed within a first volume or sump, namely gear chamber 12 that is formed by joining gear housing 22 and main housing 40. Hydraulic motor assembly 10 also includes a motor 50 housed within a second volume or sump, namely motor chamber 14 that is formed by joining motor housing 60 and main housing 40. These two volumes can be hydraulically separate or in fluid communication with one another. In the illustrated first embodiment of hydraulic motor assembly 10, there is no fluid passage formed in main housing 40 to connect the first volume (gear chamber 12) to the second volume (motor chamber 14). In this instance, motor chamber 14 is sealed off from gear chamber 12 by a pressure seal (not shown) through which motor shaft 56 passes from one chamber to the next. A result of separating gear chamber 12 from motor chamber 14 is less wear on motor running surface 60*a* due to reduced contamination of the hydraulic fluid driving motor 50. A fluid passage between gear chamber 12 and motor chamber 14 can be added, if desired, and fluid can be filtered in a known manner, if deemed necessary or desirable for a particular hydraulic system configuration.

A gear assembly 20, depicted herein as a three-stage reduction assembly comprising a pinion gear, two combination gears, and a spur gear concentric with and engaged to an output shaft, can consist of one or more reduction stages depending on the particular vehicle or apparatus application. The various gears and shafts depicted herein can be supported in the housings in various ways known in the art. The gear assembly 20 initiates with pinion gear 21, which is driven by an end of motor shaft 56. Gear assembly 20 terminates with concentric drive gear 32 for driving output shaft 24 via the mating of splines 32*a* and 24*a*. Output shaft 24 is depicted as a tubular, hex cross-sectioned, output shaft and is configured as a through-shaft in hydraulic motor assembly 10, being accessible at each end through corresponding openings in gear housing 22 and main housing 40. Output shaft 24 includes hex mating surface 24*b* which is shaped to engage a correspondingly shaped shaft or axle (not shown). Gear assembly 20, as configured, serves to reduce the output speed of, and increase the torque to, output shaft 24.

Figure 8:
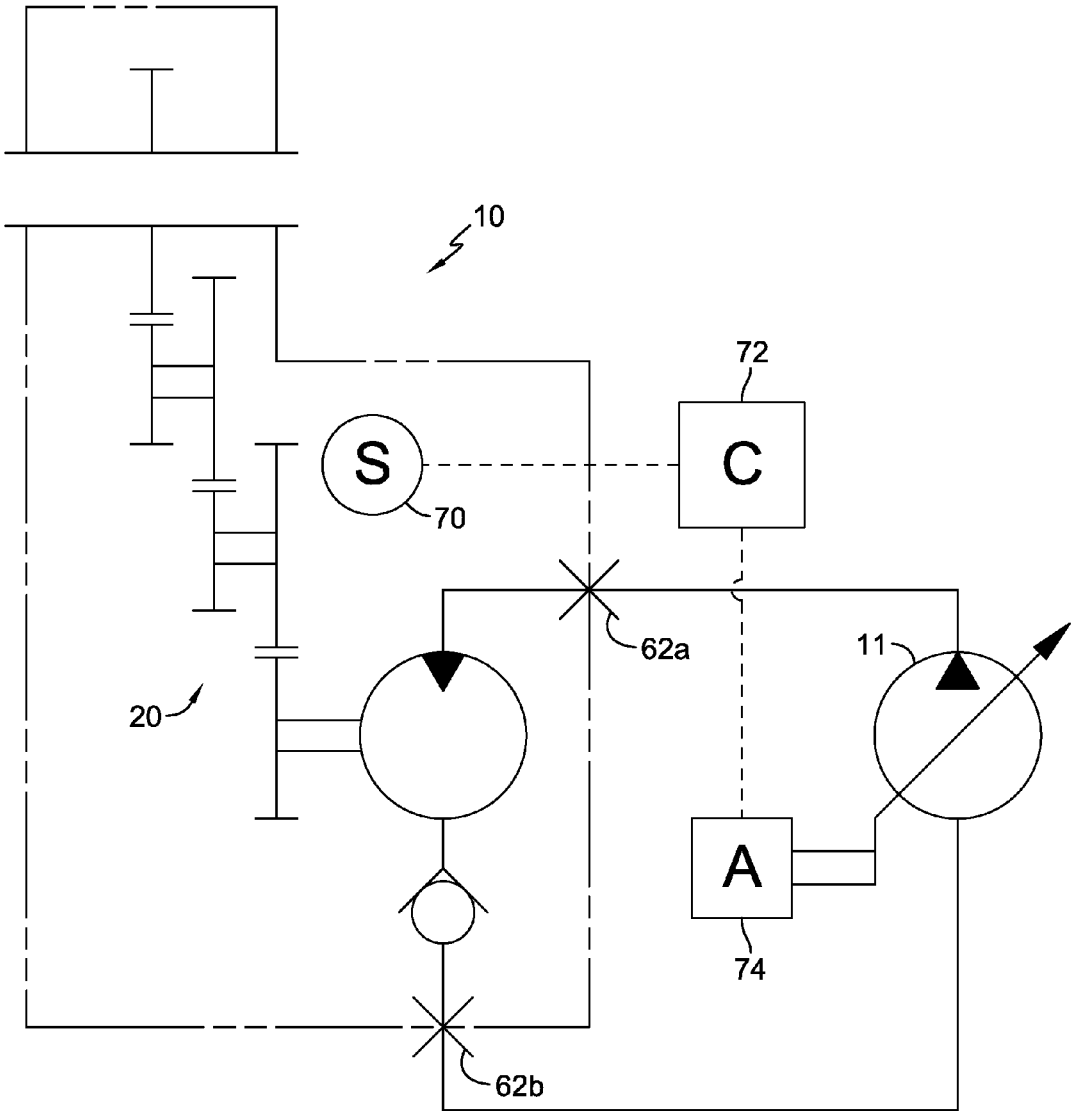
FIG. 8 is a schematic diagram of a hydraulic circuit with electronic control incorporating the first embodiment.

Rotational drive is provided to gear assembly 20 by means of a hydraulic motor 50, depicted herein as comprising axial piston cylinder block 52 disposed on the running surface 60*a*, also known as a hydraulic mounting surface, that is formed on motor housing 60. It will be understood that a valve plate could optionally be used if necessary between cylinder block 52 and running surface 60*a*. Motor housing 60 includes hydraulic passages 61*a* and 61*b* formed therein to provide fluid communication between the kidney ports 68*a* and 68*b*, respectively, of running surface 60*a* and hydraulic ports 62*a* and 62*b*, respectively, on the exterior of motor housing 60. As shown in FIG. 8, hydraulic ports 62*a* and 62*b* in turn provide fluid communication with additional elements of a hydraulic circuit, namely pump 11. Motor shaft 56, supported partially by motor housing 60 and partially by main housing 40, includes splines (not shown) that are mated with splines 52*a* of cylinder block 52. Cylinder block 52 is rotated by hydraulic fluid flow provided through a hydraulic circuit by a pump, such as pump 11 in FIG. 8, to drive motor shaft 56. Cylinder block 52 receives pistons 54 that ride on thrust bearing 58 and communicate with kidney ports 68*a* and 68*b* that are formed on running surface 60*a*.

As shown in FIG. 3, an internal case drain may be provided in the form of a slot 60*b* that connects an annular groove 60*c* formed about running surface 60*a* to kidney port 68*b*, and consequently, to hydraulic passage 61*b* and hydraulic port 62*b*. Thus, slot 60*b* places motor chamber 14 in fluid communication with kidney port 68*b*. As configured, hydraulic port 62*b* is necessarily serving as the discharge port of hydraulic motor assembly 10, while hydraulic port 62*a* serves as the inlet port. Thus, any fluid build-up in motor chamber 14 is evacuated through hydraulic port 62*b*.

To prevent damage to any housing or shaft seals from high pressure hydraulic fluid moving through the internal case drain, as in the instance of an operator inadvertently reversing the hydraulic lines to hydraulic ports 62*a* and 62*b*, an optional check valve, in this case check ball retainer 64 and check ball 66, can be installed in hydraulic discharge port 62*b*. Thus, unidirectional fluid flow in the hydraulic motor assembly 10 is established. If bidirectional motor operation is desired, an external case drain (not shown) can be provided and the check ball retainer 64 and check ball 66 can be eliminated. To balance the flow of hydraulic fluid into hydraulic port 62*a* and out of hydraulic port 62*b* when check ball retainer 64 and check ball 66 are present, the inside diameter of hydraulic port 62*b* is enlarged relative to that of hydraulic port 62*a*. The specific sizes can be determined based on the application.

Speed sensor 70 (e.g., a Hall effect sensor) fits into an external port 40*a* formed in main housing 40, and passes therethrough to the gear chamber 12 to sense the speed of one of the gears of gear assembly 20. As illustrated in FIG. 8, speed sensor 70 is preferably connected to an electronic controller 72 for the hydraulic circuit that regulates the flow of hydraulic fluid from the corresponding pump 11 by means of, e.g., an electro-mechanical actuator 74, thus permitting precise control of the output of hydraulic motor assembly 10 based, at least in part, on feedback from the speed sensor 70, a signal corresponding to the rotational speed of an element of gear assembly 20. Additional operational inputs and sensor feedback from other components of a vehicle or powered implement (not shown) could be evaluated by the electronic controller in determining the output of hydraulic motor assembly 10.

Figure 5:
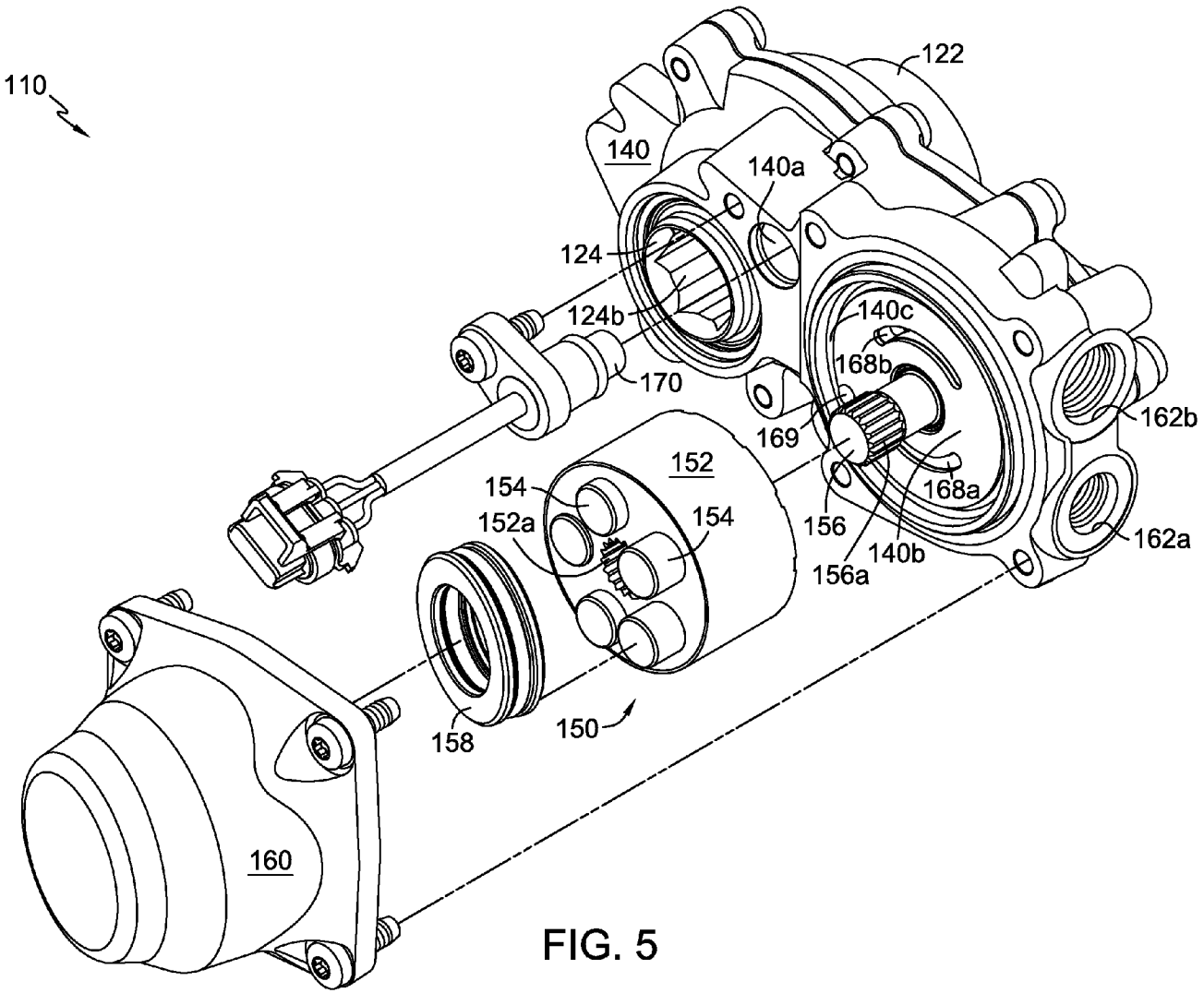
FIG. 5 is a partially exploded perspective view of the hydraulic motor assembly with speed sensor of FIG. 4.
Figure 6:
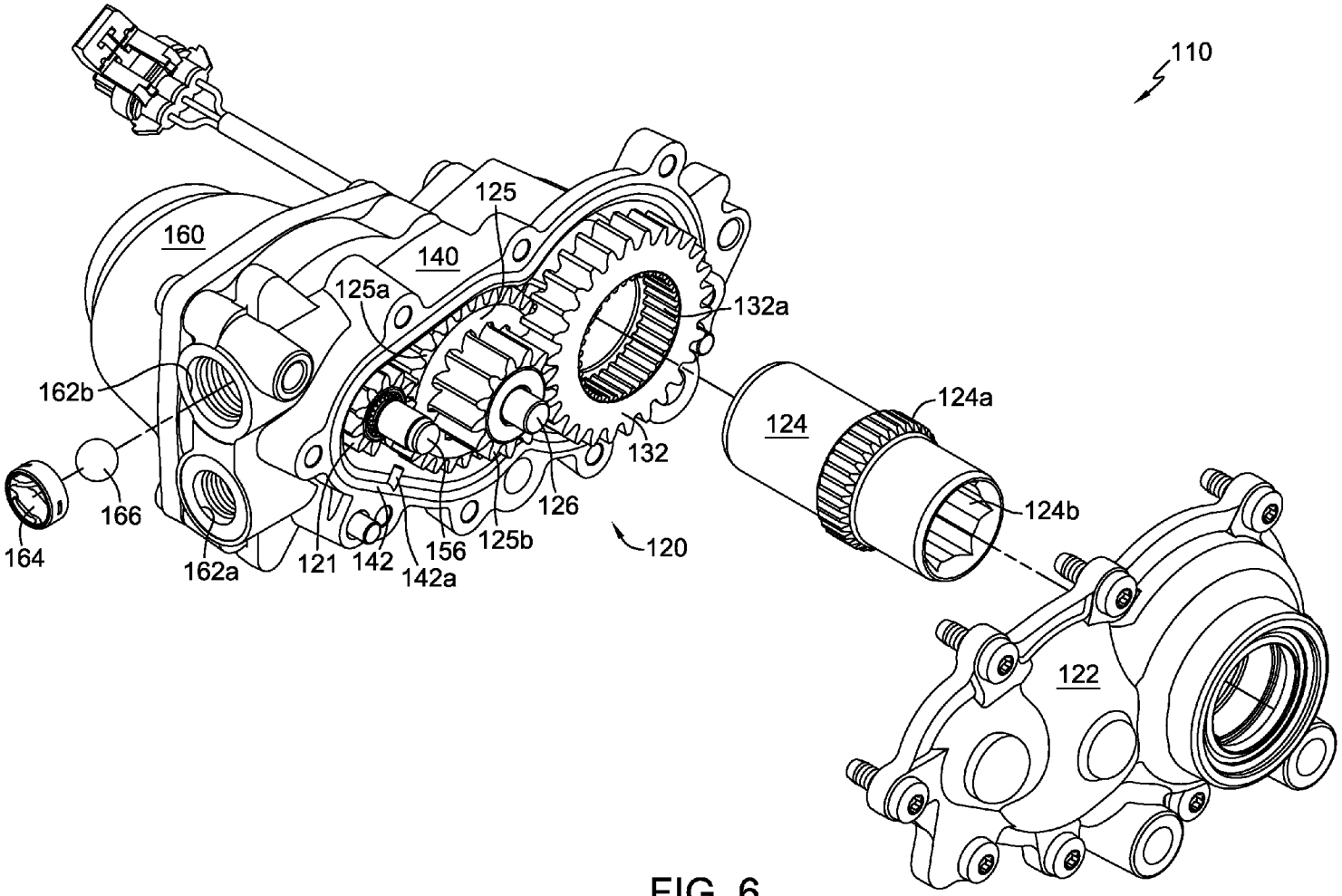
FIG. 6 is another partially exploded perspective view of the hydraulic motor assembly with speed sensor of FIG. 4.
Figure 7:
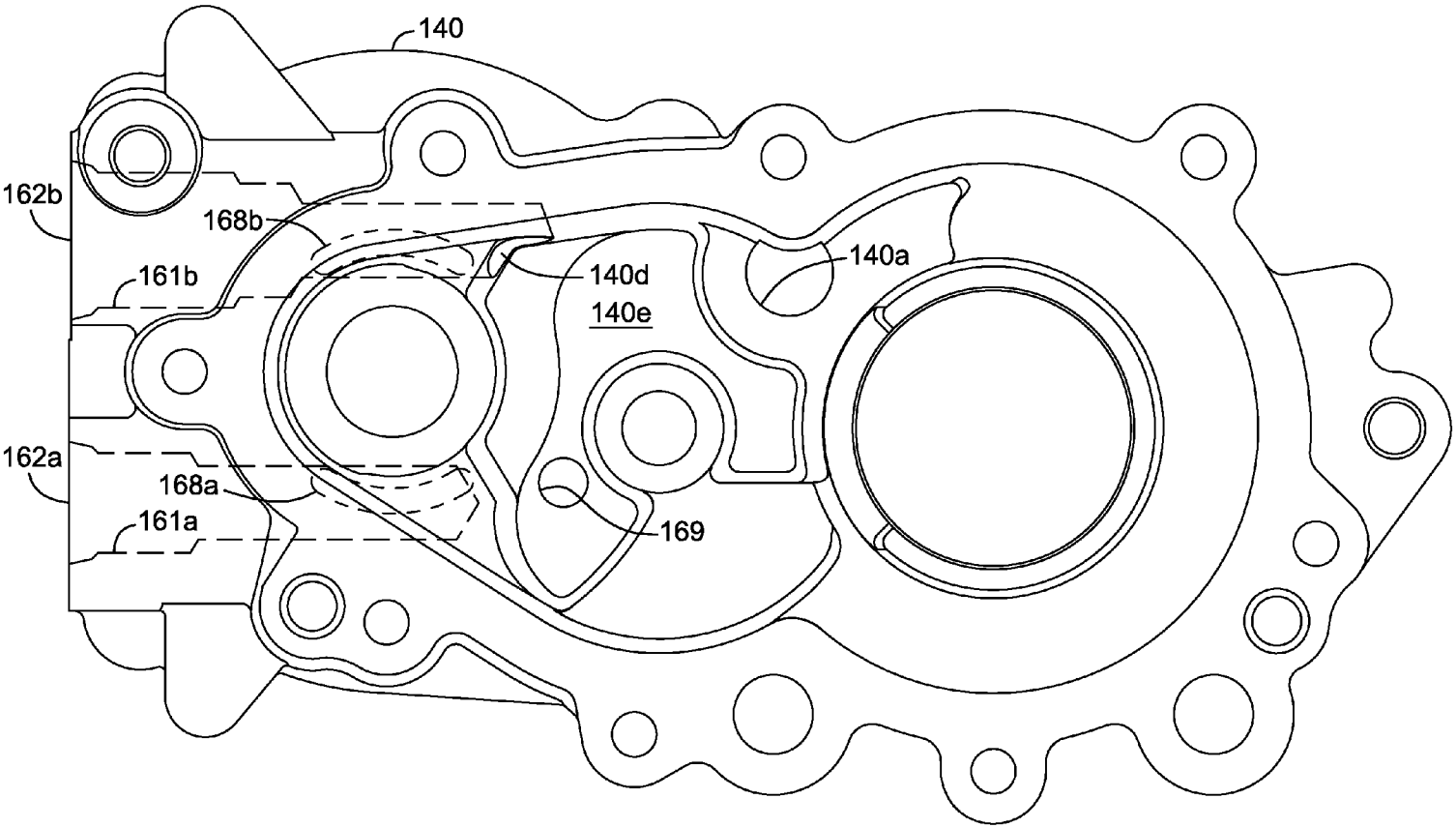
FIG. 7 is an elevational view of a main housing of the hydraulic motor assembly with speed sensor of FIG. 4.

Referring to FIGS. 4-7, a second embodiment of a hydraulic motor assembly 110 of the present invention includes a gear assembly 120 housed within a first volume, namely gear chamber 112, that is formed by joining gear housing 122 and main housing 140. Hydraulic motor assembly 110 also includes a motor 150 housed within a second volume, namely motor chamber 114, that is formed by joining motor housing 160 and main housing 140. Similar to the first embodiment, these two volumes can be hydraulically separate or in fluid communication with one another. In hydraulic motor assembly 110, a fluid passage 169 is provided to connect these two volumes, forming a common sump. Referring to FIGS. 5 and 7, fluid passage 169 is formed in main housing 140, passing through the plane of motor running surface 140*b* while intersecting an adjacent annular groove 140*c* on a first side of main housing 140, and emerging at gear chamber surface 140*e* on the opposite side of main housing 140. The specific location of fluid passage 169 is not critical provided it does not interfere with the operation of hydraulic motor 150 and its porting; for example, fluid passage 169, or a series of passages, could have been located entirely within annular groove 140*c*.

As shown in FIG. 6, the joint between main housing 140 and gear housing 122 can be sealed with a pre-formed, asymmetrical O-ring style seal 142 having an optional alignment nub 142*a* that can serve as a visual positioning indicator or can interface with a mating feature (not shown) formed in either main housing 140 or gear housing 122. This assembly aid is not required and, optionally, a standard O-ring can be installed in an o-ring groove (not shown) formed in either main housing 140 or gear housing 122. Other known sealing means, such as a liquid sealant, may be used to seal the various housing members of hydraulic motor assembly 110. Gear assembly 120, depicted in FIG. 6 as a two-stage reduction assembly, can consist of one or more reduction stages depending on the particular vehicle or apparatus application. The various gears and shafts depicted herein can be supported in the housings in various ways known in the art. The gear assembly 120 initiates with pinion gear 121, which is driven by motor shaft 156.

Pinion gear 121 drives a combination gear 125 that is supported on jackshaft 126. The combination gear 125 includes a gear form 125*a* drivingly engaged with pinion gear 121 and a gear form 125*b* drivingly engaged with concentric drive gear 132. Concentric drive gear 132 drives output shaft 124 via the mating of splines 132*a* and 124*a*. Output shaft 124, which is configured as a through-shaft in hydraulic motor assembly 110, is accessible at each end through corresponding openings in gear housing 122 and main housing 140, and includes a hex mating surface 124*b* which is shaped to engage a correspondingly shaped shaft or axle (not shown). Gear assembly 120, as configured, serves to reduce the output speed of, and increase the torque to, output shaft 124.

Motor 150, depicted herein as an axial piston motor, includes a cylinder block 152 disposed on a running surface 140*b* formed on main housing 140. In this embodiment, main housing 140 includes hydraulic passages 161*a* and 161*b* formed therein that provide fluid communication between the kidney ports 168*a* and 168*b*, respectively, of running surface 140*b* and the hydraulic ports 162*a* and 162*b*, respectively, on the exterior of main housing 140. Hydraulic ports 162*a* and 162*b* in turn provide fluid communication with additional elements of a hydraulic circuit (not shown) that includes a pump (not shown). Motor shaft 156, supported partially by main housing 140 and partially by gear housing 122, includes splines 156*a* that are mated with splines 152*a* of cylinder block 152. Cylinder block 152 is rotated by hydraulic fluid flow provided by a pump in the hydraulic circuit (not shown) to drive motor shaft 156. Cylinder block 152 receives pistons 154 that ride on thrust bearing 158 and communicate with kidney ports 168*a* and 168*b* that are formed on the motor running surface 140*b*.

For the same reasons as discussed for the first embodiment, an internal case drain is provided for hydraulic motor assembly 110. The presence of hydraulic porting and passages in the main housing, along with the inclusion of fluid passage 169 between motor chamber 114 and gear chamber 112, permit a simple opening 140*d* into hydraulic passage 161*b* to serve as an internal case drain linking gear chamber 112 to hydraulic port 162*b*. Hydraulic port 162*b* necessarily serves as the discharge port for hydraulic motor assembly 110 to insure proper functioning of the internal case drain.

An optional check valve comprising retainer 164 and check ball 166 is installed in hydraulic port 162*b*, and the internal diameter of hydraulic port 162*b* is larger than that of the hydraulic port 162*a* serving as the inlet port.

Speed sensor 170 (e.g., a Hall effect sensor) fits into speed sensor port 140*a* of main housing 140 to sense the rotational speed of an element of the hydraulic motor assembly 110, such as one of the gears or gear forms (e.g. gear form 125*a*) of the gear assembly 120. Similar to the first embodiment, the feedback provided by speed sensor 170 can be transmitted to an electronic controller (not shown) for the hydraulic circuit that regulates the flow of hydraulic fluid from the corresponding pump (not shown); thus permitting precise control of the output of hydraulic motor assembly 110.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention.

The invention claimed is:

1. A hydraulic motor assembly comprising:

a housing comprising a main housing having a first surface and an opposing second surface, a motor housing engaged to the first surface of the main housing to form a motor chamber, and a gear housing engaged to the opposing second surface of the main housing to form a gear chamber, wherein the housing further comprises a running surface and a pair of passages, wherein a first of the pair of passages connects a first port on the running surface to an inlet port on the exterior of the housing, and a second of the pair of passages connects a second port on the running surface to a discharge port on the exterior of the housing;

a cylinder block located in the motor chamber and rotatably disposed on the running surface;

a motor shaft axially engaged to the cylinder block to rotate therewith, wherein the motor shaft extends from the motor chamber to the gear chamber;

a gear set disposed in the gear chamber and rotatably engaged to the motor shaft;

a tubular output shaft rotatably engaged to the gear set; and a speed sensor located in part adjacent to the gear set to measure the rotational speed of one of the gears of the gear set.

2. The hydraulic motor assembly of claim 1, wherein the running surface and the pair of passages are formed integral to the motor housing.

3. The hydraulic motor assembly of claim 2, wherein the motor chamber is sealed off from the gear chamber by a pressure seal along the motor shaft.

4. The hydraulic motor assembly of claim 2, further comprising a check valve located in the discharge port and an internal case drain to place the motor chamber in fluid communication with the discharge port.

5. The hydraulic motor assembly of claim 4, wherein the internal case drain comprises a slot that places the motor chamber in fluid communication with the second port.

6. The hydraulic motor assembly of claim 4, wherein the discharge port has an inside diameter that is greater than an inside diameter of the inlet port.

7. The hydraulic motor assembly of claim 1, wherein the running surface and the pair of passages are formed integral to the main housing.

8. The hydraulic motor assembly of claim 7, further comprising a check valve located in the discharge port and an internal case drain to place the motor chamber in fluid communication with the discharge port.

9. The hydraulic motor assembly of claim 8, wherein the discharge port has an inside diameter that is greater than an inside diameter of the inlet port.

10. The hydraulic motor assembly of claim 7, further comprising a connecting passage from the motor chamber to the gear chamber, wherein the motor chamber and the gear chamber form a common sump.

11. The hydraulic motor assembly of claim 1, wherein the tubular output shaft is accessible through corresponding openings in the main housing and the gear housing.

12. The hydraulic motor assembly of claim 1, wherein the speed sensor is mounted to the exterior of the main housing and passes therethrough into the gear chamber.

13. The hydraulic motor assembly of claim 1, wherein one of the gears of the gear set is concentrically disposed about the tubular output shaft to engage and drive the tubular output shaft.

14. The hydraulic motor assembly of claim 1, wherein the gear set produces a mechanical reduction.

15. A hydraulic motor assembly including a hydraulic motor having a cylinder block and an electronic controller to meter the flow of hydraulic fluid from a pump in fluid communication with the hydraulic motor based at least in part on sensor feedback from the hydraulic motor, the hydraulic motor assembly comprising:

a housing comprising a main housing, a motor housing engaged to the main housing to form a motor chamber, and a gear housing engaged to the main housing to form a gear chamber;

a hydraulic mounting surface located in the housing, wherein the cylinder block is rotatably disposed on the hydraulic mounting surface;

a motor shaft axially engaged to the cylinder block and supported by the hydraulic mounting surface proximate to a first end of the motor shaft, the motor shaft extending from the motor chamber through the main housing and to the gear chamber;

a plurality of cooperating gears located in the housing and rotationally engaged to a second end of the motor shaft;

an output shaft rotationally engaged to the plurality of cooperating gears; and a speed sensor located proximate to one of the plurality of cooperating gears, wherein the speed sensor transmits a signal to the electronic controller indicative of the rotational speed of the one of the plurality of cooperating gears.

16. The hydraulic motor assembly of claim 15, wherein the hydraulic mounting surface is formed integral to the housing.

17. The hydraulic motor assembly of claim 15, wherein the output shaft extends from the housing at each of its ends.

18. A hydraulic motor assembly comprising:

a housing having a motor chamber and a gear chamber;

a running surface disposed in the motor chamber and comprising a first port and a second port;

a hydraulic circuit in communication with the running surface and comprising a first passage connecting the first port on the running surface to an inlet port on the exterior of the housing, and a second passage connecting the second port on the running surface to a discharge port on the exterior of the housing;

a cylinder block located in the motor chamber and rotatably disposed on the running surface and in fluid communication with the hydraulic circuit through the first port and the second port;

a motor shaft axially engaged to the cylinder block to rotate therewith, wherein the motor shaft extends from the motor chamber to the gear chamber;

a gear set disposed in the gear chamber and rotatably engaged to the motor shaft;

an output shaft rotatably engaged to the gear set;

a check valve located in the discharge port; and an internal case drain in fluid communication with the discharge port that enables fluid to flow from the motor chamber to the discharge port.

19. The hydraulic motor assembly of claim 18, wherein the internal case drain comprises a slot that places the motor chamber in fluid communication with the second port.

20. The hydraulic motor assembly of claim 18, wherein the internal case drain comprises a drain passage that places the gear chamber in fluid communication with the discharge port.

21. The hydraulic motor assembly of claim 18, wherein the discharge port has an inside diameter that is greater than an inside diameter of the inlet port.

22. The hydraulic motor assembly of claim 18, wherein the housing comprises a plurality of housing elements joined together, and the running surface is integrally formed on one of the plurality of housing elements.

23. A hydraulic motor assembly comprising:

a housing having a motor chamber, a gear chamber, a running surface, and a pair of passages, wherein a first of the pair of passages connects a first port on the running surface to an inlet port on the exterior of the housing and a second of the pair of passages connects a second port on the running surface to a discharge port on the exterior of the housing, wherein the running surface includes an internal case drain formed therein placing the motor chamber in fluid communication with the discharge port, wherein the internal case drain includes an annular groove formed in the running surface and a slot formed in the running surface, wherein the annular groove surrounds the first port and the second port and the slot places the annular groove in fluid communication with the second port;

a cylinder block located in the motor chamber and rotatably disposed on the running surface;

a motor shaft axially engaged to the cylinder block to rotate therewith, wherein the motor shaft extends from the motor chamber to the gear chamber;

a gear set disposed in the gear chamber and rotatably engaged to the motor shaft;

a tubular output shaft rotatably engaged to the gear set; and a speed sensor located in part adjacent to the gear set to measure the rotational speed of one of the gears of the gear set.

24. A hydraulic motor assembly comprising:

a housing having a motor chamber, a gear chamber, a running surface, and a pair of passages, wherein a first of the pair of passages connects a first port on the running surface to an inlet port on the exterior of the housing and a second of the pair of passages connects a second port on the running surface to a discharge port on the exterior of the housing, the discharge port having an inside diameter greater than an inside diameter of the inlet port;

a cylinder block located in the motor chamber and rotatably disposed on the running surface;

a motor shaft axially engaged to the cylinder block to rotate therewith, wherein the motor shaft extends from the motor chamber to the gear chamber;

a gear set disposed in the gear chamber and rotatably engaged to the motor shaft;

a tubular output shaft rotatably engaged to the gear set; and a speed sensor located in part adjacent to the gear set to measure the rotational speed of one of the gears of the gear set.

* * * * *